US005677067A

United States Patent [19]

Kojima et al.

[11] Patent Number: 5,677,067

[45] Date of Patent: Oct. 14, 1997

[54] INK JET RECORDING SHEET

[75] Inventors: Osamu Kojima; Masayuki Tsubaki; Hiroshi Tomimasu; Yasumine Yoshida, all of Tokyo, Japan

[73] Assignee: Mitsubishi Paper Mills Limited, Tokyo, Japan

[21] Appl. No.: 495,679

[22] PCT Filed: Feb. 28, 1994

[86] PCT No.: PCT/JP94/00317

§ 371 Date: Aug. 2, 1995

§ 102(e) Date: Aug. 2, 1995

[87] PCT Pub. No.: WO94/18394

PCT Pub. Date: Aug. 18, 1994

[30] Foreign Application Priority Data

| | | | |
|---|---|---|---|
| Mar. 2, 1993 | [JP] | Japan | 5-041120 |
| May 13, 1993 | [JP] | Japan | 5-111881 |
| Jun. 28, 1993 | [JP] | Japan | 5-157058 |
| Jun. 29, 1993 | [JP] | Japan | 5-158345 |
| Jul. 13, 1993 | [JP] | Japan | 5-172991 |

[51] Int. Cl.[6] ..... B41M 5/00; B41J 2/01

[52] U.S. Cl. ..... 428/478.2; 428/195; 428/478.8; 428/480; 428/513; 428/532; 428/535

[58] Field of Search ..... 428/195, 478.2, 428/532, 478.8, 480, 513, 535; 347/105

[56] References Cited

U.S. PATENT DOCUMENTS

| | | | |
|---|---|---|---|
| 4,169,188 | 9/1979 | Nagai et al. | 428/513 |
| 4,649,064 | 3/1987 | Jones | 427/256 |
| 4,650,714 | 3/1987 | Kojima et al. | 428/341 |
| 4,701,837 | 10/1987 | Sakaki et al. | 346/135.1 |
| 4,946,741 | 8/1990 | Aono et al. | 428/336 |
| 5,474,843 | 12/1995 | Lambert et al. | 428/327 |

FOREIGN PATENT DOCUMENTS

| | | | |
|---|---|---|---|
| 0 175 353 | 3/1986 | European Pat. Off. . | |
| 0 380 133 | 8/1990 | European Pat. Off. | 428/195 |
| 0 445 327 | 9/1991 | European Pat. Off. | 428/195 |
| 61-181679 | 8/1986 | Japan | 428/195 |
| 1-146784 | 6/1989 | Japan | 428/195 |
| 3-296565 | 12/1991 | Japan | 428/195 |

*Primary Examiner*—Bruce H. Hess

*Attorney, Agent, or Firm*—Armstrong, Westerman, Hattori, McLeland & Naughton

[57] ABSTRACT

Disclosed are ink jet recording sheets comprising specific ink-receiving layers on supports. The ink jet recording sheets give excellent images.

4 Claims, No Drawings

INK JET RECORDING SHEET

This application is the national stage of International Application PCT/JP94/00317, filed Feb. 28, 1994 and amended on Feb. 6, 1995, which claims the priority of Japanese Patent Applications 05-041120, filed Mar. 2, 1993; 05-111881, filed May 13, 1993; 05-157058, filed Jun. 28, 1993; 05-158345, filed Jun. 29, 1993; and 05-1772991, filed Jul. 13, 1993.

TECHNICAL FIELD

The present invention relates to ink jet recording sheets to which mainly an aqueous ink is applied. More particularly, it relates to ink jet recording sheets which give excellent images.

BACKGROUND ART

The ink jet recording method performs recording of images or letters by allowing ink droplets ejected by various working principles on a recording sheet such as paper. Ink jet printers have such favorable features that they make high-speed recording possible, that they produce little noise, that there is no limitation as to kind of patterns or images, and that it requires no processing for development and fixing, and attract attention in that they can accurately and quickly produce complicated images. Especially, the ink jet printers are rapidly becoming widespread in various fields as devices for producing hard copies of image information such as letters and various graphics produced by computers. Furthermore, they can easily perform multi-color recording by using a plurality of ink nozzles. The images formed by the multi-color ink jet recording method are comparable to those printed by a multi-color press or those obtained by a color-photography. Besides, use of the ink jet recording extends to a field of full-color image recording where the number of copies is not so many, since costs per copy are less than those employing the photographic process. The application fields of particular notice recently are production of color mechanicals in the printing industry, production of full-color copies of graphics in the fashion or promotion industries, and so forth. An another expanding field of note is transparency for OHP (overhead projector); color copies of a picture, graph, chart and the like drawn by aid of a computer are ink-jet printed and increasingly used for presentations.

As for the recording sheets used for ink jet recording, efforts have been made from the aspects of printer hardwares or ink composition in order to use woodfree paper or coated paper used for ordinary printing or writing. However, improvements in recording sheets have come to be required increasingly in order to go side by side with developments in printer hardwares such as ever increasing speed, development of ever finer definition images of full color, and also with expanding fields of uses. That is, recording sheets are demanded to develop ever high image reproducibility, and in order to meet that demand, it is required that image density of the printed dots be maintained high and hue characteristics be bright and appealing, the ink applied be fixed quickly and does not bleed or spread even though a different color ink is put over additionally. Moreover, ink should set quickly, dots should not spread more than needed and the circumference of dots be sharp and demarcating. Especially, in the case of color recording, not only the monochromatic recording of yellow, magenta, cyan or black is carried out, but also recording by overlapping these colors is carried out and amount of ink applied to the recording sheet further increases and very severe performances of the sheet are required.

When a conventional ink absorbing layer is provided on the recording sheet which is used for OHP, that layer—if porous, blocks light transmission of the sheet even if a transparent support is used; if non-porous, light transmission may be improved, but aqueous ink receptivity of the layer is poor, therefore ink remains wet on the surface of the sheet and printed image tends to be smudged during the time the sheet is run on a printer.

For solution of these problems, various ink jet recording sheets provided with a transparent ink absorbing layer high in ink receptivity have been proposed. For example, there have been proposed use of polyvinyl alcohol and polyacrylic acid type water-soluble polymer in Japanese Patent Application Kokai No. 60-168651, use of hydroxyethylcellulose in Japanese Patent Application Kokai No. 60-262685, use of a mixture comprising carboxymethylcellulose and polyethylene oxide in Japanese Patent Application Kokai No. 61-181679, use of a mixture comprising a water-soluble cellulose and polyvinyl pyrrolidone in Japanese Patent Application Kokai No. 61-193879, use of a receiving layer formed of a gelatin solution having a specific pH in Japanese Patent Application Kokai No. 62-263084 and use of a mixture comprising gelatin and a surface active agent in Japanese Patent Application Kokai No. 1-146784.

The ink jet recording sheets described in these patent applications are superior in light transmission and improved in ink receptivity, but are still insufficient, especially in dots reproducibility, and are hardly acceptable as recording sheets for high image quality color hard copies.

EP 380 133 A1 describes a recording medium and image forming method making use of it. The recording medium comprises a substrate and an ink-receiving layer provided on said substrate, wherein said ink-receiving layer contains a reaction product of a gelling agent with a coupling agent. The image forming method comprises applying ink-jet recording to the recording medium, thereby forming an image.

EP 445 327 A1 discloses a recording medium for ink-jet recording. The recording medium comprises a polyolefin-coated substrate having an ink-receiving layer provided on the upper side thereof, wherein the ink-receiving layer contains a mixture of gelatine and rice starch.

The object of the present invention is to provide ink jet recording sheets which give excellent quality images.

An aqueous ink to be used for ink jet recording is composed mainly of water and a polyhydric alcohol, and is designed to inhibit plugging of ink conduits or nozzles in the printer head and to improve discharging characteristics. I order to develop high quality image, it is necessary that ink-receiving layer can quickly absorb the ink and can control spreading of the ink.

DISCLOSURE OF THE INVENTION

As a result of intensive research, the inventors have found that an ink jet recording sheet that can develop high quality images can be obtained by providing specific ink-receiving layers on supports.

According to the first aspect of the present invention, there is provided an ink jet recording sheet comprising a support and an ink-receiving layer provided on the support wherein the ink-receiving layer contains a low-molecular weight gelatin having a molecular weight of 100,000 or less in an amount of at least 30% by weight in solid content based on the total solid content of the ink-receiving layer, mucochloric acid in an amount of 0.1–1% by weight in solid content based on the gelatin content and carboxymethylcellulose having a molecular weight of 100,000 or less and an etherification degree of 1% or less.

According to the second aspect of the present invention, there is provided an ink jet recording sheet comprising a support and an ink-receiving layer provided on the support wherein the ink-receiving layer contains a polymer compound obtained by reacting a polyoxyalkylene glycol containing an ethylene oxide chain with at least one compound selected from polycarboxylic acids, polycarboxylic acid anhydrides, lower alkyl esters of polycarboxylic acids and organic polyisocyanates.

Furthermore, the inventors have found that when psychometric lightness L and psychometric chroma coordinates a and b according to the CIELAB (abbreviation of "L*a*b* color system recommended by the Commission Internationale de l'Echairage") are within a specific range, the sheet shows excellent visual whiteness and sharpness of the resulting image is high and color reproducibility is superior.

According to the third aspect of the present invention, there is provided an ink jet recording sheet comprising a support and an ink-receiving layer provided on the support wherein the surface of the ink-receiving layer has a psychometric lightness L and psychometric chroma coordinates a and b which are specified in JIS-Z8730 and measured by the method specified in JIS-Z8722 are 87 or more, and −2 to +2 and −3 to +3, respectively.

According to the fourth aspect of the present invention, there is provided an ink jet recording sheet comprising a support and an ink-receiving layer provided on at least one side of the support wherein the support is a polyolefin resin-coated paper and the surface of the resin coat layer on which the ink-receiving layer is provided has a psychometric lightness L and psychometric chroma coordinates a and b which are specified in JIS-Z8730 and measured by the method specified in JIS-Z8722 are 90 or more, and −2 to +2 and −5 to 0, respectively.

According to the fifth aspect of the present invention, there is provided an ink jet recording sheet comprising a support and an ink-receiving layer provided on at least one side of the support wherein the surface of the ink-receiving layer has a psychometric lightness L and psychometric chroma coordinates a and b which are specified in JIS-Z8730 and measured by the method specified in JIS-Z8722 are 87 or more, and −2 to +2 and −3 to +3, respectively and the ink-receiving layer comprises a non-spherical cationic colloidal silica and a binder.

The first aspect of the present invention is described below.

As the gelatin contained in the ink-receiving layer, a gelatin having a molecular weight of 100,000 or less is used. When the molecular weight is more than 100,000, the gelatin is inferior in compatibility with carboxymethylcellulose to result in decrease in uniformity of image density formed on the ink-receiving layer.

Any gelatins which are prepared from collagen of animals can be used in the present invention. Preferred are those which are prepared from pig skin, beef skin and beef bone. Kind of gelatin is not critical and there may be used lime-treated gelatins, acid-treated gelatins and gelatin derivatives each alone or in combination of two or more (e.g., gelatin derivatives described in Japanese Patent Kokoku Nos. 38- 4854, 39-5514, 40-12237 and 42-26345, U.S. Pat. Nos. 2,525,753, 2,594,293, 2,614,928, 2,763,639, 3,118,766, 3,132,945, 3,186,846 and 3,312,553, and British Patent Nos. 861,414 and 1,033,189).

Jelly strength of the gelatin (measured by PAGI method using a bloom type jelly strength meter) is preferably 150 g or higher, especially preferably 200–300 g.

Coating weight of the ink-receiving layer is not specifically limited, but is preferably 3–50 g/m$^2$, more preferably 5–30 g/m$^2$ in solid content. When the coating weight of the layer is less than 3 g/m$^2$, the sheet is inferior in ink-receptivity and the ink flows out of the ink-receiving layer after printing. When it is more than 50 g/m$^2$, ink-receptivity is improved, but there occur problems such as cracking and curling of the ink-receiving layer.

Amount of mucochloric acid is preferably 0.1–1.0% by weight in solid content based on the gelatin. When the amount of mucochloric acid is less than 0.1% by weight, hardening of the ink-receiving layer is insufficient and ink-received portion of the layer swell or even flow after printing. When it is more than 1.0% by weight, ink-receptivity is inferior and dot reproducibility becomes poor.

Molecular weight of carboxymethylcellulose is 100,000 or less and etherification degree thereof is 1% or less. When the molecular weight exceeds 100,000 or the etherification degree exceeds 1%, viscosity increases to deteriorate coatability.

Amount of carboxymethylcellulose is not specifically limited, but the weight ratio of carboxymethylcellulose to the gelatin is preferably in the range of 5/95–70/30, more preferably 10/90–60/40 for improving ink-receptivity and dot reproducibility.

The ink-receiving layer may contain surface active agents in addition to the binder for improving dot reproducibility. The surface active agents may be any of anionic type, cationic type, nonionic type and betaine type and may be of low molecular or high molecular ones. One or two or more of the surface active agents are added to the coating composition for the ink-receiving layer. When two or more surface active agents are used in combination, it is not preferred to use anionic surface active agent and cationic surface active agent in combination. Amount of the surface active agent is preferably 0.001–5 g, more preferably 0.01–3 g in solid content based on 100 g of the binder which constitutes the ink-receiving layer.

The ink-receiving layer may additionally contain various known additives such as inorganic pigment, color pigment, dye, fixer for ink dyes, ultraviolet absorber, antioxidant, dispersing agent, defoamer, leveling agent, preservative, fluorescent brightener, viscosity stabilizer and pH adjustor.

The coating composition liquor for the ink-receiving layer can be coated by conventionally employed methods such as slide hopper method, curtain method, extrusion method, air knife method, roll coating method and rod bar coating method.

The ink-receiving layer is provided on at least one side of a support, but the layers may be provided on both sides for inhibition of curling.

Thickness of the polyester film which can be used as a support is not specifically limited, but preferably is about 10–200 μm from the points of handling property and runnability on a printer.

Thickness of the polyolefin resin-coated paper which can be used as the support also is not specifically limited, but preferably is about 50–300 μm from the points of handling property and runnability in a printer.

The base paper used for the resin-coated paper is not specifically limited and may be any of that which is generally used. Preferred is base paper having smooth surface such as one used for photographic support. Fibers which constitute the base paper may be one or more of natural fiber, recycled fiber and synthetic fiber. To the base paper stock, there may be added additives generally used for paper making such as sizing agent, strengthening agent, loading agent, antistatic agent, fluorescent brightener and dye. Furthermore, the surface of the base paper may be coated with surface sizing agent, surface strengthening agent, fluorescent brightener, antistatic agent, dye, anchoring agent and the like.

The base paper preferably is one processed by a calender or the like during or after paper making and having a high surface smoothness; its basis weight is preferably 30–250 $g/m^2$.

The polyethylene resin may be a low-density polyethylene, a medium-density polyethylene, a high-density polyethylene or a mixture thereof. The low-density polyethylene referred to herein is one having a density of 0.915–0.930 $g/cm^3$ and prepared normally by high-pressure process; the high-density polyethylene, one having a density of 0.950 $g/cm^3$ or higher and prepared normally by low-pressure process or medium-pressure process. These polyethylene resins can be used each alone or in combination of two or more having different density and melt flow rate.

The resin layer of the resin-coated paper may be of either single-layer construction or multi-layer construction comprising two or more layers. In this case, too, the above-mentioned polyolefin resins can be used alone or in combination of two or more. Furthermore, the layers of the multi-layer construction may have different compositions from one another or may have the same composition. The resin layers of multi-layer construction may be coated by either coextrusion coating method or successive coating method.

Thickness of the resin layer in the resin-coated paper is not specifically limited, but the layer is generally coated at a thickness of 5–50 μm on one side only or on both sides.

The resin of the resin-coated paper may contain, in optional combination, white pigments such as titanium oxide, zinc oxide, talc and calcium carbonate, fatty acid amides such as stearamide and arachidamide, metal salts of fatty acids such as zinc stearate, calcium stearate, aluminum stearate and magnesium stearate, antioxidants such as Irganox 1010 and Irganox 1076, blue pigments or dyes such as cobalt blue, ultramarine blue, Sicilian blue and phthalocyanine blue, magenta pigments or dyes such as cobalt violet, Fast Violet and Manganese Purple, fluorescent brighteners and ultraviolet absorbers.

The resin-coated paper is produced by so-called extrusion coating method which comprises casting a molten polyethylene resin composition on a running base paper. For improving bond between the resin layer and the base paper, it is preferred to subject the base paper to activation treatments such as corona discharge treatment and flame treatment before coating the resin on the base paper. The side of the support on which the ink-receiving layer is coated (front side) may have a glossy surface or a matte surface depending on its use and the glossy surface is especially preferred. The back side may not necessarily be coated with resin, but is preferably coated with resin for inhibition of curling. The back side, if coated with resin, normally has a dull surface, and this side of the base paper also can be subjected to activation treatments such as corona discharge treatment and flame treatment.

The support can be provided with a variety of antistatic or anti-curling backcoat layers for improving runnability. The backcoat layer may contain, in optional combination, inorganic antistatic agent, organic antistatic agent, hydrophilic binder, latex, hardener, pigment and surface active agent.

According to the first aspect of the present invention, gelatin quickly absorbs the ink, so that the ink does not remain wet on the sheet surface and drying or fixing proceeds quickly. Furthermore, by restricting the amount of mucochloric acid to 0.1–1.0% by weight in solid content based on gelatin, cross-linking degree of gelatin is controlled and proper water absorbency and water resistance are rendered to the sheet. Moreover, carboxymethylcellulose has the effect to restrain swelling of gelatin film to inhibit excessive spread of ink dots.

The second aspect of the present invention is described below.

One component used for producing the polymer compound contained in the ink-receiving layer is a polyoxyalkylene glycol. The polyoxyalkylene glycol is obtained by addition polymerization of an organic active hydrogen compound having two groups containing active hydrogen groups with an alkylene oxide containing ethylene oxide. Examples of the organic active hydrogen compound are ethylene glycol, diethylene glycol, propylene glycol, dipropylene glycol, 1,4-butanediol, 1,6-hexanediol, neopentyl glycol, bisphenol, polyethylene glycol, polypropylene glycol, polytetramethylene glycol, butylamine, octylamine, laurylamine and cyclohexylamine.

The alkylene oxide used for the addition polymerization contains ethylene oxide as an essential component and may additionally contain propylene oxide, butylene oxide, styrene oxide or the like.

Examples of the polycarboxylic acids or anhydrides thereof or lower alkyl esters thereof are enumerated below.

(a) Malonic acid, succinic acid, maleic acid, fumaric acid, adipic acid, sebacic acid, phthalic acid, isophthalic acid, terephthalic acid, itaconic acid, trimellitic acid, pyromellitic acid and dimer acid.

(b) Monomethyl ester, dimethyl ester, monoethyl ester, diethyl ester, monopropyl ester, dipropyl ester, monobutyl ester or dibutyl ester of the acids enumerated in the above (a).

(c) Anhydrides of the acids enumerated in the above (a).

Examples of the organic polyisocyanates to be reacted with polyoxyalkylene glycol are tolylene diisocyanate, 4,4'-methylenebis(phenyl isocyanate), hexamethylene diisocyanate, isophorone diisocyanate, xylylene diisocyanate, 4,4-methylenebis(cyclohexyl isocyanate), 4,4-isopropylidene-bis(cyclohexyl isocyanate) and trimethylhexamethylene diisocyanate.

Molecular weight of the polymer compound contained in the ink-receiving layer is preferably 50,000–300,000. When the molecular weight is less than 50,000, the compound is inferior in water resistance and the ink-receiving layer dissolves after printing and sharp image cannot be obtained. When the molecular weight is more than 300,000, viscosity of the coating solution increases, resulting in deterioration of coatability such as inferior coated surface.

Dry coating weight of the ink-receiving layer is preferably 1–30 $g/m^2$. When the coating weight is less than 1 $g/m^2$, ink receptivity of the ink-receiving layer is poor it is likely that the ink bleeds on the ink-receiving layer after printing and smudges the printed image due to mingling of colors or due to contact of the printed image with an object. When the coating weight is more than 30 $g/m^2$, the ink sinks too deep into the ink-receiving layer resulting in poor image resolution and curling of the recording sheet.

The ink-receiving layer may contain in addition to the polymer compound various binders for the purposes of improving film strength and imparting water resistance. The binders are preferably water-soluble polymers such as starches or derivatives, various gelatins, polyvinyl alcohols or modification products thereof, polyvinyl pyrrolidone, carboxymethylcellulose, hydroxyethylcellulose and latexes such as SBR latex and NBR latex.

Amount of the polymer compound is preferably 2% by weight or more based on the weight of the dry weight of the ink-receiving layer. When the amount of the polymer compound is less than 2% by weight, the advantageous effects of the present invention cannot be sufficiently exhibited and ink jet recording sheets which can afford images of high quality cannot be obtained.

The ink-receiving layer can contain surface active agents for improving coatability. The surface active agents may be any of anionic, cationic, nonionic and amphoteric types. Molecular weight of the surface active agents is not specifically limited and it is also possible to add two or more surface active agents. Amount of the surface active agents is preferably 0.001–5 g, more preferably 0.01–3 g in solid content per 100 g of solid of the ink-receiving layer.

The ink-receiving layer may further contain the additives referred to in the explanation of the first aspect.

The ink-receiving layer may be coated by normally employed methods such as slide hopper method, curtain method, extrusion method, air knife method, roll coating method and rod coating method.

The ink-receiving layer is provided on at least one side of the support and the layers may be coated on both sides for inhibition of curling.

As the support, there may be used paper, metallic foil, synthetic paper, fabric, nonwoven fabric or composites thereof, but polyolefin resin-coated paper and film are preferred from the points of image quality, gloss and smoothness. Thickness of the support is not specifically limited, but is preferably about 50–300 μm from the points of handling property and runnability on a printer.

The base paper preferably is one processed by a calender or the like during or after paper making and having a high surface smoothness; its basis weight is preferably 30–250 $g/m^2$.

The resin coat layer can be provided on one or both sides of the base paper and, but the resin coat layers are preferably provided on both sides of the base paper for inhibition of curling.

The resin-coated paper used as the support is produced by so-called extrusion coating method which comprises casting a heat-molten polyolefin resin on a running base paper or the emulsion coating method which comprises coating a resin emulsion on the base paper. When the extrusion coating method is employed, the base paper is preferably subjected to activation treatments such as corona discharge treatment and flame treatment before being coated with the resin for improving bond between the resin and the base paper. When the emulsion coating method is employed, it is preferred to carry out smoothening treatments such as hot calender treatment after coating.

The resin layer of the resin-coated paper may be of either single-layer construction or multi-layer construction comprising two or more layers. In this case, the polyolefin resins can be used alone or in combination of two or more. Furthermore, the layers of the multi-layer construction may have different compositions from one another or may have the same composition. The resin layers of multi-layer construction may be coated by either coextrusion coating method or successive coating method.

Thickness of the resin layer of the resin-coated paper is not specifically limited, but is preferably 5–50 μm.

The resin of the resin-coated paper may contain, in optional combination, various additives, for example, white pigments such as titanium oxide, zinc oxide, talc and calcium carbonate, kaolin clay, fatty acid amides such as stearamide and arachidamide, metal salts of fatty acids such as zinc stearate, calcium stearate, aluminum stearate and magnesium stearate, antioxidants such as Irganox 1010® and Irganox 1076®, blue pigments or dyes such as cobalt blue, ultramarine blue, Sicilian blue and phthalocyanine blue, magenta pigments or dyes such as cobalt violet, Fast Violet and Manganese Purple, fluorescent brighteners and ultraviolet absorbers.

The film may be either transparent film or opaque film and a polyester film is preferred in view of strength properties and cost.

The side of the support on which the ink-receiving layer is coated (front side) has glossy surface, matte surface or the like depending on the use and the glossy surface is especially preferred.

A subcoat layer can be provided on the support before coated with the ink-receiving layer in order to improve coatability of the coating composition liquor of the ink-receiving layer. The subcoat layer may contain various water-soluble polymers, latexes, hardeners, surface active agents in optional combination.

As in the case of the first aspect, the support can be provided with various backcoat layers for antistatic purpose, for improving runnability or for inhibition of curling. The backcoat layer may contain, in optional combination, inorganic antistatic agent, organic antistatic agent, hydrophilic binder, latex, hardener, pigment and surface active agent.

According to the second aspect of the present invention, an ink jet recording sheet capable of recording images of good quality which does not smudge due to mingling of colors in the contour portion or due to contact in running of the sheet on a printer can be obtained by adding to the ink-receiving layer a polymer compound obtained by reacting a polyoxyalkylene glycol containing an ethylene oxide chain with at least one compound selected from polycarboxylic acids, polycarboxylic acid anhydrides, lower alkyl esters of polycarboxylic acids and organic polyisocyanates.

The third aspect of the present invention is described below.

As methods for quantitatively measuring and expressing the hue characteristics of a subject, there are methods as specified in JIS-Z8722 and JIS-Z8730. According to these methods, the hue characteristics of a subject is expressed by the three values L, a and b. The value L shows lightness and the greater value L means the higher lightness. The value a shows redness and the greater value means the stronger redness and the smaller value means the stronger greenness. The value b shows yellowness and the greater value means the stronger yellowness and the smaller value means the stronger blueness.

The value L in the third aspect is at least 87. When the value L is smaller than 87, the white color becomes grayish and becomes dull.

The value a is in the range of −2 to +2. When the value a is smaller than −2, the whole image becomes greenish and this is not preferred. When it is greater than +2, the whole image becomes reddish and this is not preferred.

The value b is in the range of −3 to +3. When the value b is smaller than −3, the whole image becomes bluish and this is not preferred. When it is greater than +3, the whole image becomes yellowish and this is not preferred.

In order to control the values L, a and b of the surface of the ink-receiving layer within the respective ranges of the present invention, various colorants are added to the ink-receiving layer.

As the colorants to be added, mention may be made of, for example, white pigments, blue dyes, red dyes and fluorescent dyes. These can be used with optionally changing the amount depending on the kind of the support, coating weight of the ink-receiving layer or the like.

As the support, there may be used non-coated paper such as woodfree paper, medium grade paper, supercalendered paper, machine glazed paper and tracing paper, coated paper such as art paper, coat paper, light weight coat paper, ultra light weight coat paper and cast coat paper, plastic films such as polyester film and cellulose acetate film, synthetic paper such as foamed polyolefin synthetic paper and foamed polyester synthetic paper, polyolefin resin-coated paper, resin-impregnated paper, nonwoven fabrics, fabrics and composites thereof.

In order to enhance ink absorbency, various pigments and resins can be used in the ink-receiving layer together with other additives. The pigments added for this purpose include, for example, silica, colloidal silica, alumina, alumina sol, magnesium carbonate, calcium carbonate, titanium oxide and zinc oxide. The resins include, for example, water-soluble resins such as starch or modification products thereof, gelatin or modification products thereof, polyvinyl alcohol or modification products thereof, polyvinyl pyrrolidone, carboxymethylcellulose, hydroxyethylcellulose, sodium polyacrylate, sodium alginate and polyacrylamide and resin emulsions such as acrylic emulsion, vinyl acetate emulsion, SBR latex and NBR latex. If necessary, the ink-receiving layer may contain additives such as anionic, cationic, nonionic or amphoteric surface active agents, dye fixing agents, ultraviolet absorbers, antioxidants, defoamers, leveling agents, preservatives, viscosity stabilizers and pH adjustors.

Dry coating weight of the ink-receiving layer is preferably 1–30 g/m$^2$. When the coating weight of the ink-receiving layer is less than 1 g/m$^2$, the sheet is inferior in ink-receptivity and the ink is apt to flow out of the ink-receiving layer after printing to cause smudging due to mingling of colors of images or due to contact of the printed image with an object. When it is more than 30 g/m$^2$, resolution of the printed image goes down due to excessive permeation of ink, and the recording sheet is apt to curl.

The coating composition liquor for the ink-receiving layer can be coated by normally employed methods such as rod method, wire bar method, slide hopper method, curtain method, extrusion dye method, air knife method, roll coating method and blade method.

In the ink jet recording sheet of the present invention, the ink-receiving layer may be of either single-layer construction or multi-layer construction comprising two or more layers. In the case of the multi-layer construction, the layers may have different compositions from one another or may have the same composition. When the multi-layers are formed, two or more layers may be coated simultaneously or may be coated successively one by one.

The ink-receiving layer is provided on at least one side of a support, but may be provided on both sides for carrying out the printing on both sides or for inhibition of curling.

According to the third aspect of the present invention, an ink jet recording sheet that has visually excellent whiteness, can form images of high sharpness and is excellent in color reproducibility is obtained by limiting psychometric lightness L and psychometric chroma coordinates a and b of the surface of the ink-receiving layer to be within the specific ranges.

The fourth aspect of the present invention is described below.

Use of a polyolefin resin-coated paper as a support is preferred because it has a high whiteness, a high gloss and a high smoothness and images of good quality can be obtained.

The value L in the present invention is at least 90. When the value L is smaller than 90, the ink jet recording sheet becomes grayish and the color of the image becomes dull.

The value a is in the range of −2 to +2. When the value a is smaller than −2, the ink jet recording sheet becomes greenish and this is not preferred. When it is greater than +2, the ink jet recording sheet becomes reddish and this is not preferred.

The value b is in the range of −5 to 0. When the value b is smaller than −5, the ink jet recording sheet becomes bluish and this is not preferred. When it is greater than 0, the ink jet recording sheet becomes yellowish and this is not preferred.

In order to control the values L, a and b of the surface of the support on which the ink-receiving layer is to be coated within the respective ranges of the present invention, various colorants are added to the base paper layer, the intermediate layer or the resin coat layer. The colorants added are preferably excellent in light resistance and heat resistance and can be used with optionally changing the amount depending on the hue characteristics or coating weight of the ink-receiving layer. Examples of the colorants are pigments or dyes such as titanium dioxide, zinc oxide, barium sulfate, calcium carbonate, talc, kaolin, clay, silica, alumina and magnesium oxide as white colorants, cobalt blue, ultramarine, sicilian blue and phthalocyanine blue as blue colorants, quinacridone red, anthraquinone red, bisazo red and isoindolinone red as red colorants, bisazo yellow and isoindolinone yellow as yellow colorants, and cobalt violet, fast violet and manganese purple as purple colorants and fluorescent dyes such as stilbene, distilbene, benzoxazole, coumarin, imidazole, benzimidazole and pyrazoline dyes.

The base paper for the polyolefin resin-coated paper as a support is not specifically limited and may be any of generally used papers. The base paper may comprise fibers such as natural pulp, recycled fiber and synthetic pulp each alone or in admixture. Furthermore, the base paper may contain additives such as sizing agent, strengthening agent, fixing agent, electroconducting agent and pH adjustor generally used for paper making as well as the above-mentioned pigments or dyes. The base paper may be coated or impregnated with pigment, dye, water-soluble resin, resin emulsion, sizing agent, strengthening agent, electroconducting agent, anchoring agent or the like. The base paper is preferably calendered by a machine calender, hot calender, soft calender, super calender or the like to improve surface smoothness during or after paper making.

The polyolefin resin-coated paper is produced by the melt-extrusion coating method which comprises casting a heat-molten polyolefin resin on a running base paper or the emulsion coating method which comprises coating a polyolefin resin emulsion and drying the coat. The resin coat layer may be provided on one or both sides of the base paper, but the resin coat layers are preferably coated on both sides for inhibition of curling. In preparation of the polyolefin resin-coated paper, the base paper is preferably subjected to surface activation treatments such as corona discharge treatment, flame treatment and providing of anchoring layer for improving bond between the polyolefin resin and the base paper.

As the polyolefin resin which constitutes the resin coat layer, homopolymers or copolymers of ethylene, propylene, 1-butene, 1-pentene, 1-hexene, 4-methyl-1-pentene, 1-heptene, 1-octene, 1-nonene or the like can be used. The resin coat layer can contain various additives such as lubricant, antioxidant, ultraviolet absorber, plasticizer, adhesive, hardener or the like in addition to the polyolefin resin, pigment and dye mentioned above.

The resin coat layer may be of either single-layer construction or multi-layer construction. The layers of the multi-layer construction may have different compositions from one another or may have the same composition. When the resin layers of the multi-layer construction is formed, two or more layer may be coated simultaneously or may be successively coated one by one. Thickness of the resin coat layer is preferably at least 10 μm for obtaining satisfactory smoothness.

An intermediate layer may be provided between the support and the ink-receiving layer for the purpose of enhancing bond between the support and the ink-receiving layer and improving surface reflective characteristics of the ink jet recording sheet. The intermediate layer may contain, in addition to the above-mentioned pigments or dyes, water-soluble resin, resin emulsion, surface active agent, ultraviolet absorber, antioxidant, antifoamer, leveling agent, preservative, thickener, pH adjustor and the like.

The intermediate layer may be coated on the support by normally employed coating methods such as rod method, wire bar method, slide hopper method, curtain method, extrusion die method, air knife method, roll method and blade method.

As in the third aspect of the present invention, the ink-receiving layer may contain various pigments and resins together with other additives for enhancing the ink receptivity.

The ink-receiving layer is provided on at least one side of the support, but may be coated on both sides for making the both functional to ink jet printing or for inhibiting curling. The ink-receiving layer may be of either single-layer construction or multi-layer construction comprising two or more layers. In the case of multi-layer construction, the layers may have different compositions from one another or may have the same composition. The multi-layers may be coated simultaneously or may be coated successively one by one.

Dry coating weight of the ink-receiving layer is preferably 1–30 g/m$^2$. When the coating weight of the ink-receiving layer is less than 1 g/m$^2$, the sheet is inferior in ink-receptivity and the ink is apt to flow out of the ink-receiving layer after printing to cause smudging due to mingling of colors of images or due to contact of the printed image with an object. When it is more than 30 g/m$^2$, resolution of the printed image goes down due to excessive permeation of ink, and the recording sheet is apt to curl.

The ink-receiving layer, or the intermediate layer as well, may be coated on the support by normally employed coating methods such as rod method, wire bar method, slide hopper method, curtain method, extrusion die method, air knife method, roll method and blade method.

A backcoat layer may be provided on the side of the support opposite to the ink-receiving layer side is provided for the purposes of inhibiting curling and blocking of the recording sheet, or for raising electric conductivity and imparting writability with a pencil or ball-point pen. The backcoat layer may contain pigment, water-soluble resin, resin emulsion, surface active agent, conducting agent, hardener, antifoamer, leveling agent, preservative, viscosity stabilizer, pH adjustor and the like.

The backcoat layer may be coated on the support by normally employed coating methods such as rod method, wire bar method, slide hopper method, curtain method, extrusion die method, air knife method, roll method and blade method.

According to the fourth aspect of the present invention, an ink jet recording sheet that has a visually excellent whiteness and can form images of high sharpness and is excellent in color reproducibility is obtained by using as a support a polyolefin resin-coated paper whose surface to be coated with the ink-receiving layer has the values L, a and b according to CIELAB falling within a specific range.

Next, the fifth aspect of the present invention will be explained.

In order to control the values L, a and b of the surface of the ink-receiving layer within the respective ranges of the present invention, various colorants are added to the ink-receiving layer.

As the colorants, there may be used coloring pigments, coloring dyes, fluorescent dyes and the like, and they can be used with optionally changing the amount depending on the kind of support and coating weight of the ink-receiving layer.

As the supports, there may be used those which are referred to in the third aspect.

The ink-receiving layer is mainly composed of a non-spherical cationic colloidal silica and a binder in order to increase ink absorbency and improve dot reproducibility and water resistance.

The non-spherical cationic colloidal silica is one which is cation-modified by covering the surface thereof with a hydrous metal oxide. The "non-spherical" herein means "substantially not spherical" and acicular or fibrous colloidal silica is preferred. The size the silica is preferably several nm to about 500 nm in the length of major axis.

The hydrous metal oxides used for the cationic modification of non-spherical colloidal silica include, for example, hydrous aluminum oxide, hydrous zirconium oxide and hydrous tin oxide. Especially preferred are those which are cation-modified with hydrous aluminum oxide. The cationic modification can be carried out by the processes described in U.S. Pat. No. 3,007,878, Japanese Patent Kokoku No. 47-26959 and the like.

The covering weight of the hydrous metal oxide as a cationic modifier in the non-spherical cationic colloidal silica is suitably 1–30% by weight based on the weight of silica (as $SIO_2$). When the covering weight of the cationic modifier is too small, dot reproducibility and water resistance of the ink jet recording sheet are poor and when it is too large, the ink-receiving layer becomes brittle and is apt to crack. Therefore, the covering weight is especially preferably 2.5–25% by weight, most preferably 5–20% by weight. The dispersion of the non-spherical cationic colloidal silica may contain an acid component such as acetic acid, citric acid, sulfuric acid or phosphoric acid as a colloid stabilizer. As specific examples of the non-spherical cationic colloidal silica, mention may be made of ST-special modification series supplied by Nissan Chemical Co., Ltd.

Examples of the binder used in the ink-receiving layer include various gelatins such as lime-treated gelatin, acid-treated gelatin, enzyme-treated gelatin, gelatin derivatives, e.g., gelatins reacted with anhydrides of dibasic acids such as phthalic acid, maleic acid and fumaric acid, polyvinyl alcohols of various saponification degrees, carboxy-modified, cation-modified and amphoteric polyvinyl alcohols or derivatives thereof, starches such as oxidized starch, cationized starch and etherified starch, cellulose derivatives such as carboxymethylcellulose and hydroxyethylcellulose, synthetic polymers such as polyvinyl pyrrolidone, polyvinylpyridinium halides, salts of sodium polyacrylate, acrylic acid-methacrylic acid copolymer, polyethylene glycol, polypropylene glycol, polyvinyl ether, alkylvinyl ether-maleic anhydride copolymer and styrene-maleic anhydride copolymer or salts thereof and polyethyleneimine, latexes of conjugated diene copolymers such as styrene-butadiene copolymer and methyl methacrylate-butadiene copolymer, latexes of vinyl acetate polymers such as polyvinyl acetate, vinyl acetate-maleate ester copolymer, vinyl acetate-acrylate ester copolymer and ethylene-vinyl acetate copolymer, latexes of acrylic polymers or copolymers such as acrylate ester polymer, methacrylate ester polymer, ethylene-acrylate ester copolymer and styrene-acrylate ester copolymer, latexes of vinylidene chloride copolymer, functional group-modified polymer latexes obtained by modifying these various polymers with monomers containing functional group such as carboxyl group, aqueous adhesives such as thermosetting synthetic resins, e.g., melamine resin and urea resin, and synthetic resin adhesives such as polymethyl methacrylate, polyurethane resin, unsaturated polyester resin, vinyl chloride-vinyl acetate copolymer, polyvinyl butyral and alkyd resin. These may be used each alone or in combination of two or more.

Amount of these binder may vary depending on a balance between the confilicting requirements, i.e. ink absorbency vs. dot reproducibility and water resistance, but is suitably 2–100 parts by weight, especially preferably 5–30 parts by weight based on 100 parts by weight in solid content of the non-spherical cationic colloidal silica.

The ink-receiving layer may contain various surface active agents for improving sharpness of images. The surface active agents may be any of anionic, cationic, nonionic or betaine type and besides, may be of low molecule or high molecule. Furthermore, one or two or more of them may be used.

As preferred examples of the surface active agents, mention may be made of anionic surface active agents such as long chain alkylbenzenesulfonates and long chain, preferably branched alkylsulfosuccinates, nonionic surface active agents such as polyalkylene oxide ethers of long chain, preferably branched alkyl group-containing phenols and polyalkylene oxide ethers of long chain alkyl alcohols, and fluorinated surface active agents described in Japanese Patent Kokoku No. 47-9303 and U.S. Pat. No. 3,589,906.

Amount of the surface active agent is preferably 0.1–7% by weight, more preferably 0.5–3% by weight based on dry solid weight of the ink-receiving layer.

The ink-receiving layer may contain various additives in addition to the non-spherical cationic colloidal silica, binder and surface active agent.

Examples of the additives are silica, colloidal silica, magnesium carbonate, calcium carbonate, titanium oxide and zinc oxide as pigments; γ-aminopropyltriethoxysilane and N-β-(aminoethyl) γ-aminopropyltrimethoxysilane as silane coupling agents; active halogen compounds, vinylsulfone compounds, aziridine compounds, epoxy compounds, acryloyl compounds and isocyanate compounds as hardeners for polymers; p-hydroxybenzoate ester compounds, benzisothiazolone compounds and isothiazolone compounds described in Japanese Patent Kokai No. 1-102551 as preservatives; color pigments, dyes and fluorescent dyes described in Japanese Patent Application Kokai Nos. 63-204251 and 1-266537; benzotriazole compounds having hydroxy-di-alkylphenyl group at 2-position as ultraviolet absorbers; polyhindered phenol compounds described in Japanese Patent Application Kokai No. 1-105245 as antioxidants; organic or inorganic fine particles of 0.2–5 μm such as starch particles, barium sulfate and silica and organopolysiloxanes described in Japanese Patent Kokoku No. 4-1337 as pencil writing agents; sodium hydroxide, sodium carbonate, sulfuric acid, hydrochloric acid, phosphoric acid, and citric acid as pH adjustors; and octyl alcohol and silicone antifoamers. These may be used in optional combination.

Dry coating weight of the ink-receiving layer is preferably 1–30 g/m$^2$. When the coating weight of the ink-receiving layer is less than 1 g/m$^2$, the sheet is inferior in ink-receptivity and the ink is apt to flow out of the ink-receiving layer after printing to cause smudging due to mingling of colors of images or due to contact of the printed image with an object. When it is more than 30 g/m$^2$, resolution of the printed image goes down due to excessive permeation of ink, and the recording sheet is apt to curl.

The ink-receiving layer may be coated on the support by normally employed coating methods such as rod method, wire bar method, slide hopper method, curtain method, extrusion die method, air knife method, roll method and blade method.

As in the case of the third aspect, the ink-receiving layer may be of either single-layer construction or multi-layer construction comprising two or more layers. In the case of multi-layer construction, the layers may have different compositions from one another or may have the same composition. The multi-layers may be coated simultaneously or may be coated successively one by one.

The ink-receiving layer is provided on at least one side of the support, but may be provided on both sides for effecting the printing on both sides or for inhibition of curling.

According to the fifth aspect of the present invention, an ink jet recording sheet that has a visually excellent whiteness, can give images of high sharpness and good color reproducibility and is excellent in dot reproducibility and water resistance can be obtained by providing an ink-receiving layer mainly composed of a non-spherical colloidal silica and a binder, the psychometric lightness L, and psychometric chroma coordinates a and b of the surface of the ink-receiving layer being within specific ranges, ink-receiving layers on supports. The ink jet recording sheets give excellent images.

BEST MODE FOR CARRYING OUT THE INVENTION

The present invention is illustrated by the following nonlimiting examples. In these examples, all parts are by weight.

EXAMPLE 1

On the front side of a base paper comprising LBKP and having a basis weight of 100 g/m$^2$ was coated with 25 g/m$^2$ of a resin composition comprising 85 parts by weight of a low-density polyethylene and 15 parts by weight of titanium dioxide. On the back side of the base paper was coated with 20 g/m$^2$ of a resin composition comprising 50 parts by weight of a high-density polyethylene and 50 parts by weight of a low-density polyethylene to obtain a resin-coated paper. The front side of the resin-coated paper was subjected to corona treatment and then coated with a coating composition for ink-receiving layer of the following formulation at a dry coating weight of 8 g/m$^2$ by an extrusion method. Immediately thereafter, the coat was set by cooling for 10 seconds and the coated paper was passed through a drying zone having gradually increasing temperatures with controlling the temperature and the humidity in the drying zone so that the surface wet-bulb temperature was lower than 20° C. to obtain an ink jet recording sheet.

Formulation 1 for ink-receiving layer:

| | |
|---|---|
| Low-molecular weight gelatin (molecular weight: 95,000) | 50 parts |
| Carboxymethylcellulose (molecular weight: 80,000 and etherification degree: 0.8%) | 50 parts |
| Mucochloric acid | 0.3 part |

EXAMPLE 2

An ink jet recording sheet was prepared by coating a coating composition for ink-receiving layer of the following formulation in the same manner as in Example 1 on the same support as used in Example 1.

Formulation 2 for ink-receiving layer:

| | |
|---|---|
| Low-molecular weight gelatin (molecular weight: 70,000) | 30 parts |
| Carboxymethylcellulose (molecular weight: 80,000 and etherification degree: 0.8%) | 70 parts |
| Mucochloric acid | 0.2 part |

EXAMPLE 3

An ink jet recording sheet was prepared by coating a coating composition for ink-receiving layer of the following formulation in the same manner as in Example 1 on the same support as used in Example 1.

Formulation 3 for ink-receiving layer:

| | |
|---|---|
| Low-molecular weight gelatin (molecular weight: 70,000) | 50 parts |
| Carboxymethylcellulose (molecular weight: 80,000 and etherification degree: 0.8%) | 50 parts |
| Mucochloric acid | 0.05 part |

EXAMPLE 4

An ink jet recording sheet was prepared by coating a coating composition for ink-receiving layer of the following formulation in the same manner as in Example 1 on the same support as used in Example 1.

Formulation 4 for ink-receiving layer:

| | |
|---|---|
| Low-molecular weight gelatin (molecular weight: 70,000) | 50 parts |
| Carboxymethylcellulose (molecular weight: 100,000 and etherification degree: 1.0%) | 50 parts |
| Mucochloric acid | 0.5 part |

EXAMPLE 5

An ink jet recording sheet was prepared by coating a coating composition for ink-receiving layer of the following formulation in the same manner as in Example 1 on the same support as used in Example 1.

Formulation 5 for ink-receiving layer:

| | |
|---|---|
| Low-molecular weight gelatin (molecular weight: 70,000) | 50 parts |
| Carboxymethylcellulose (molecular weight: 100,000 and etherification degree: 1.0%) | 50 parts |
| Mucochloric acid | 0.3 part |

EXAMPLE 6

An ink jet image receiving sheet was prepared by coating a coating composition for ink-receiving layer of the following formulation in the same manner as in Example 1 except that a polyethylene terephthalate film having a thickness of 100 μm was used as a support in place of the resin-coated paper used in Example 1.

Formulation 6 for ink-receiving layer:

| | |
|---|---|
| Low-molecular weight gelatin (molecular weight: 70,000) | 50 parts |
| Carboxymethylcellulose (molecular weight: 80,000 and etherification degree: 0.8%) | 50 parts |
| Mucochloric acid | 0.3 part |

EXAMPLE 7

An ink jet recording sheet was prepared by coating a coating composition for ink-receiving layer of the following formulation in the same manner as in Example 1 on the same support as used in Example 1.

Formulation 7 for ink-receiving layer:

| | |
|---|---|
| Low-molecular weight gelatin (molecular weight: 120,000) | 50 parts |
| Carboxymethylcellulose (molecular weight: 80,000 and etherification degree: 0.8%) | 80 parts |
| Mucochloric acid | 0.3 part |

EXAMPLE 8

An ink jet recording sheet was prepared by coating a coating composition for ink-receiving layer of the following formulation in the same manner as in Example 1 on the same support as used in Example 1.

Formulation 8 for ink-receiving layer:

| | |
|---|---|
| Low-molecular weight gelatin (molecular weight: 70,000) | 20 parts |
| Carboxymethylcellulose (molecular weight: 80,000 and etherification degree: 0.8%) | 80 parts |
| Mucochloric acid | 0.1 part |

EXAMPLE 9

An ink jet recording sheet was prepared by coating a coating composition for ink-receiving layer of the following formulation in the same manner as in Example 1 on the same support as used in Example 1.

Formulation 9 for ink-receiving layer:

| | |
|---|---|
| Low-molecular weight gelatin (molecular weight: 70,000) | 50 parts |

-continued

| | |
|---|---|
| Carboxymethylcellulose (molecular weight: 80,000 and etherification degree: 0.8%) | 50 parts |
| Mucochloric acid | 0.04 part |

EXAMPLE 10

An ink jet recording sheet was prepared by coating a coating composition for ink-receiving layer of the following formulation in the same manner as in Example 1 on the same support as used in Example 1.

Formulation 10 for ink-receiving layer:

| | |
|---|---|
| Gelatin (molecular weight: 70,000) | 50 parts |
| Carboxymethylcellulose (molecular weight: 80,000 and etherification degree: 0.8%) | 50 parts |
| Mucochloric acid | 0.6 part |

EXAMPLE 11

An ink jet recording sheet was prepared by coating a coating composition for ink-receiving layer of the following formulation in the same manner as in Example 1 on the same support as used in Example 1.

Formulation 11 for ink-receiving layer:

| | |
|---|---|
| Low-molecular weight gelatin (molecular weight: 70,000) | 50 parts |
| Carboxymethylcellulose (molecular weight: 120,000 and etherification degree: 0.8%) | 50 parts |
| Mucochloric acid | 0.3 part |

EXAMPLE 12

An ink jet recording sheet was prepared by coating a coating composition for ink-receiving layer of the following formulation in the same manner as in Example 1 on the same support as used in Example 1.

Formulation 12 for ink-receiving layer:

| | |
|---|---|
| Low molecular weight gelatin (molecular weight: 70,000) | 50 parts |
| Carboxymethylcellulose (molecular weight: 80,000 and etherification degree: 0.8%) | 50 parts |
| Mucochloric acid | 0.3 part |

Images were recorded on the thus obtained specimen sheets by Desk Writer C ink jet printer supplied by Hewlett Packard Co., Ltd. and subjected to the following quality tests and the results of evaluation are shown in Table 1.

[Unevenness in image portion]

Image portion was visually evaluated and unevenness especially in overlapping ink dot image portion was evaluated.

[Spread of ink dot]

Monochromatic ink dot image or overlapping ink dot image was continuously recorded and it was visually judged whether the ink of the dots spread between adjacent image portions.

[Writability]

The density and the sharpness of the recorded letters were evaluated.

[Coatability]

It was judged whether coating composition for ink-receiving layer was difficult owing to high viscosity or not according to the following criteria;

⊙: Excellent and there is no problem to coat.

○: Good.

Δ: Practically acceptable.

x: Inferior.

TABLE 1

| Sample | Unevenness in image | Spread | Writ-ability of letters | Coat-ability |
|---|---|---|---|---|
| Example 1 | ⊙ | ○ | ⊙ | ⊙ |
| Example 2 | ○ | ○ | ○ | ⊙ |
| Example 3 | ⊙ | ⊙ | ○ | ⊙ |
| Example 4 | ○ | ○ | ⊙ | ⊙ |
| Example 5 | ○ | ○ | ○ | ⊙ |
| Example 6 | ⊙ | ⊙ | ○ | ⊙ |
| Example 7 | x | ○ | x | ⊙ |
| Example 8 | ○ | x | ○ | ⊙ |
| Example 9 | ○ | ○ | x | ⊙ |
| Example 10 | ○ | x | ○ | ⊙ |
| Example 11 | ○ | ○ | ○ | x |
| Example 12 | ○ | ○ | ○ | x |

As can be seen from the results of Table 1, the ink jet recording sheets of Examples 1–6 showed good results in all of the tests. On the other hand, when molecular weight of the gelatin was high as in Example 7, ink-receptivity was not uniform and unevenness was seen in the image, and besides, letter writability was poor because of poor compatibility of the gelatin with carboxymethylcellulose. When content of the low-molecular weight gelatin was small as in Example 8 or when content of mucochloric acid was large as in Example 10, ink-receptivity of the ink-receiving layer was inferior and the image spread much. When content of mucochloric acid was small as in Example 9, since hardening of the ink-receiving layer was insufficient, the ink-receiving layer flowed away and letter writability was poor. When molecular weight of carboxymethylcellulose was large as in Example 11 or when etherification degree of carboxymethylcellulose was high as in Example 12, viscosity of the coating composition increased to deteriorate the coatability.

As described above, an ink jet recording sheet excellent in ink adsorbency and capable of providing images excellent in sharpness, resolution and uniformity can be obtained.

EXAMPLE 13

On the front side of a base paper comprising LBKP (broad-leaved bleached kraft pulp) and having a basis weight of 100 g/m$^2$ was coated with 16 g/m$^2$ of a resin composition comprising 85 parts by weight of a low-density polyethylene and 15 parts by weight of titanium dioxide. On the back side of the base paper was coated with 16 g/m$^2$ of a resin composition comprising 60 parts by weight of a high-density polyethylene and 40 parts by weight of a low-density polyethylene to obtain a resin-coated paper. The front side of the resin-coated paper was subjected to corona treatment and then was coated with a coating composition (10% in solid content) for ink-receiving layer prepared by adding 80 parts by weight of polyvinyl alcohol to 20 parts by weight of a polymer compound (having an average molecular weight of 120,000) obtained by reacting ethylene oxide adduct of dipropylene glycol with adipic acid monoester at a dry coating weight of 10 g/m$^2$ by a bar coater and dried to obtain an ink jet recording sheet.

EXAMPLE 14

A coating composition (10% in solid content) for ink-receiving layer prepared by adding 80 parts by weight of polyvinyl alcohol to 20 parts by weight of a polymer compound (having a molecular weight of 70,000) obtained from polyethylene glycol and dimethyl terephthalate was coated in the same manner as in Example 13 on the same support as used in Example 13 to obtain an ink jet recording sheet.

EXAMPLE 15

A coating composition (10% in solid content) for ink-receiving layer prepared by adding 80 parts by weight of polyvinyl alcohol to 20 parks by weight of a polymer compound (having an average molecular weight of 170,000) obtained from ethylene oxide adduct of polytetramethylene glycol and pyromellitic acid dianhydride was coated in the same manner as in Example 13 on the same support as used in Example 13 to obtain an ink jet recording sheet.

EXAMPLE 16

An aqueous solution (10% in solid content) prepared by adding 80 parts by weight of polyvinyl alcohol to 20 parts by weight of a polymer compound (having an average molecular weight of 40,000) obtained from ethylene oxide adduct of bisphenol A and succinic anhydride was coated in the same manner as in Example 13 on the same support as used in Example 13 to obtain an ink jet recording sheet.

EXAMPLE 17

An aqueous solution (10% in solid content) prepared by adding 80 parts by weight of polyvinyl alcohol to 20 parts by weight of a polymer compound (having an average molecular weight of 320.000) obtained from polyethylene glycol and 4,4'-methylenebis-(phenyl isocyanate) was coated in the same manner as in Example 13 on the same support as used in Example 13 to obtain an ink jet recording sheet.

EXAMPLE 18

A coating composition (10% in solid content) for ink-receiving layer prepared by adding 97 parts by weight of polyvinyl alcohol to 3 parts by weight of the same polymer compound as used in Example 13 was coated in the same manner as in Example 13 on the same support as used in Example 13 to obtain an ink jet recording sheet.

EXAMPLE 19

A 10% aqueous solution of the same polymer compound as used in Example 13 was coated in the same manner as in Example 13 on the same support as used in Example 13 to obtain an ink jet recording sheet.

EXAMPLE 20

A coating composition (10% in solid content) for ink-receiving layer prepared by adding 99 parts by weight of polyvinyl alcohol to 1 part by weight of the same polymer compound as used in Example 13 was coated in the same manner as in Example 13 on the same support as used in Example 13 to obtain an ink jet recording sheet.

EXAMPLE 21

The same coating composition as used in Example 13 was coated at a dry coating weight of 1 g/m$^2$ on the same support as used in Example 13 to obtain an ink jet recording sheet.

EXAMPLE 22

The same coating composition as used in Example 13 was coated at a dry coating weight of 30 g/m$^2$ on the same support as used in Example 13 to obtain an ink jet recording sheet.

EXAMPLE 23

The same coating composition as used in Example 13 was coated at a dry coating weight of 0.5 g/m$^2$ on the same support as used in Example 13 to obtain an ink jet recording sheet.

EXAMPLE 24

The same coating composition as used in Example 13 was coated at a dry coating weight of 40 g/m$^2$ on the same support as used in Example 13 to obtain an ink jet recording sheet.

EXAMPLE 25

An ink jet recording sheet was obtained in the same manner as in Example 13 except that a polyethylene terephthalate film having a thickness of 100 μm was used in place of the resin-coated paper used as a support.

EXAMPLE 26

A 10% aqueous polyvinyl alcohol solution was coated in the same manner as in Example 13 on the same support as used in Example 13 to obtain an ink jet recording sheet.

EXAMPLE 27

An ink jet recording sheet was obtained in the same manner as in Example 26 except that a polyethylene terephthalate film having a thickness of 100 μm was used in place of the resin-coated paper used as a support.

Images were recorded on the thus obtained ink jet recording sheets by Desk Writer 550C color ink jet printer supplied by Hewlett Packard Co., Ltd. and subjected to the following quality tests and the results of evaluation are shown in Table 2.

[Sharpness of image]

Monochromatic ink dot or overlapping ink dot was continuously printed and it was visually judged whether the ink of the dots spread between adjacent image portions.

[Drying characteristics]

The overlapping solid image portion just after printing was evaluated and drying state of ink was visually evaluated.

[Coatability]

The surface of the ink-receiving layer was evaluated and state of streak lines caused by coating bar and state of unevenness in gloss were visually evaluated.

Criteria for the evaluation are as follows.

⊙: Very excellent.

○: Excellent.

Δ: Practically acceptable.

x: Bad and practically unacceptable.

TABLE 2

| Sample | Sharpness of image | Drying property | Coatability |
|---|---|---|---|
| Example 13 | ◎ | ◎ | ◎ |
| Example 14 | ○ | ○ | ◎ |
| Example 15 | ◎ | ◎ | ○ |
| Example 16 | Δ | Δ | ◎ |
| Example 17 | ○ | ◎ | Δ |
| Example 18 | ○ | ○ | ◎ |
| Example 19 | ◎ | ◎ | ◎ |
| Example 20 | Δ | Δ | ◎ |
| Example 21 | ○ | ○ | ◎ |
| Example 22 | ○ | ◎ | ◎ |
| Example 23 | Δ | Δ | ◎ |
| Example 24 | Δ | ◎ | ◎ |
| Example 25 | ◎ | ◎ | ◎ |
| Example 26 | x | x | ◎ |
| Example 27 | x | x | ◎ |

As can be seen from the results of Table 2, the ink jet recording sheets of Examples 13–25 showed satisfactory results in all tests.

On the other hand, when the specific polymer compound was not used as in Examples 26 and 27, absorption and drying of ink were insufficient and sharp images were not obtained.

As explained above, an ink jet recording sheet that can form a sharp image and is excellent in drying characteristics of ink can be obtained.

EXAMPLE 28

On the front side of a woodfree paper comprising 70% of LBKP and 30% of NBKP (needle-leaved bleached kraft pulp) and having a basis weight of 100 g/m$^2$ was coated with a coating composition for ink-receiving layer of the following formulation at a dry coating weight of 10 g/m$^2$ by an air knife coater and dried to obtain an ink jet recording sheet.

<Formulation 1 for ink-receiving layer>

| | |
|---|---|
| Silica (Carplex FPS-2 ® supplied by Shionogi & Co., Ltd.) | 100 parts |
| Colloidal silica (Snowtex C ® supplied by Nissan Chemical Industries, Ltd. | 20 parts |
| Polyvinyl alcohol (PVA 110 supplied by Kuraray Co., Ltd.) | 30 parts |
| Dye fixing agent (Catiofast PL ® supplied by BASF Japan Ltd.) | 5 parts |
| Blue dye (Blue 16L supplied by BASF Japan Ltd.) | 0.002 part |
| Red dye (Red G supplied by Nippon Kayaku Co., Ltd.) | 0.002 part |
| Fluorescent dye (Kaycoll BUL ® supplied by Nippon Soda Co., Ltd.) | 1 part |
| Surface active agent (Trax K-40 ® supplied by Nippon Oil & Fats Co., Ltd.) | 0.01 part |

EXAMPLE 29

On the front side of an art paper having a basis weight of 84.9 g/m$^2$ was coated with a coating composition for ink-receiving layer of Example 28 at a dry coating weight of 10 g/m$^2$ by an air knife coater and dried to obtain an ink jet recording sheet.

EXAMPLE 30

On the front side of a white polyethylene terephthalate film having a thickness of 100 μm was coated with a coating composition for ink-receiving layer of the following formulation at a dry coating weight of 8 g/m$^2$ by a wire bar coater and dried to obtain an ink jet recording sheet.

<Formulation 2 for ink-receiving layer>

| | |
|---|---|
| Colloidal silica (Snowtex C ® supplied by Nissan Chemical Industries, Ltd. | 100 parts |
| Carboxymethylcellulose (Cellogen BSH-12 supplied by Daiichi Kogyo Seiyaku Co., Ltd.) | 100 parts |
| Blue dye (Blue 16L supplied by BASF Japan Ltd.) | 0.002 part |
| Red dye (Red G supplied by Nippon Kayaku Co., Ltd.) | 0.002 part |
| Fluorescent dye (Kaycoll BUL ® supplied by Nippon Soda Co., Ltd.) | 0.5 part |
| Surface active agent (Trax K-40 ® supplied by Nippon Oil & Fats Co., Ltd.) | 0.02 part |

EXAMPLE 31

On the front side of a polyethylene laminate paper having a basis weight of 142.5 g/m$^2$ was coated with a coating composition for ink-receiving layer of Example 30 at a dry coating weight of 8 g/m$^2$ by a wire bar coater and dried to obtain an ink jet recording sheet.

EXAMPLE 32

An ink jet recording sheet was prepared in the same manner as in Example 28 except that a coating composition of the following formulation was used for the ink-receiving layer.

<Formulation 3 for ink-receiving layer>

| | |
|---|---|
| Silica (Carplex FPS-2 ® supplied by Shionogi & Co., Ltd.) | 100 parts |
| Colloidal silica (Snowtex C ® supplied by Nissan Chemical Industries, Ltd.) | 20 parts |
| Polyvinyl alcohol (PVA 110 supplied by Kuraray Co., Ltd.) | 30 parts |
| Dye fixing agent (Catiofast PL ® supplied by BASF Japan Ltd.) | 5 parts |
| Surface active agent (Trax K-40 ® supplied by Nippon Oil & Fats Co., Ltd.) | 0.01 part |

EXAMPLE 33

An ink jet recording sheet was prepared in the same manner as in Example 28 except that a coating composition of the following formulation was used for the ink-receiving layer.

<Formulation 4 for ink-receiving layer>

| | |
|---|---|
| Silica Carplex FPS-2 ® supplied by Shionogi & Co., Ltd.) | 100 parts |
| Colloidal silica (Snowtex C ® supplied by Nissan Chemical Industries, Ltd.) | 20 parts |
| Polyvinyl alcohol (PVA 110 supplied by Kuraray Co., Ltd.) | 30 parts |
| Dye fixing agent (Catiofast PL ® supplied by BASF Japan Ltd.) | 5 parts |
| Blue dye (Blue 16L supplied by BASF Japan Ltd.) | 0.002 part |
| Fluorescent dye (Kaycoll BUH ® supplied by Nippon Soda Co., Ltd.) | 1 part |
| Surface active agent (Trax K-40 ® supplied by Nippon Oil & Fats Co., Ltd.) | 0.01 part |

EXAMPLE 34

An ink jet recording sheet was prepared in the same manner as in Example 28 except that the coating composition of the following formulation was used for the ink-receiving layer.

<Formulation 5 for ink-receiving layer>

| | |
|---|---|
| Silica (Carplex FPS-2 ® supplied by Shionogi & Co., Ltd.) | 100 parts |
| Colloidal silica (Snowtex C ® supplied by Nissan Chemical Industries, Ltd.) | 20 parts |
| Polyvinyl alcohol (PVA 110 supplied by Kuraray Co., Ltd.) | 30 parts |
| Dye fixing agent (Catiofast PL ® supplied by BASF Japan Ltd.) | 5 parts |
| Blue dye (Blue 16L supplied by BASF Japan Ltd.) | 0.002 part |
| Red dye (Red G supplied by Nippon Kayaku Co., Ltd.) | 0.01 part |
| Fluorescent dye (Kaycoll BUL ® supplied by Nippon Soda Co., Ltd.) | 1 part |
| Surface active agent (Trax KF80 ® supplied by Nippon Oil & Fats Co., Ltd.) | 0.01 part |

EXAMPLE 35

An ink jet recording sheet was prepared in the same manner as in Example 28 except that a coating composition of the following formulation was used for the ink-receiving layer.

<Formulation 6 for ink-receiving layer>

| | |
|---|---|
| Silica (Carplex FPS-2 ® supplied by Shionogi & Co., Ltd.) | 100 parts |
| Colloidal silica (Snowtex C ® supplied by Nissan Chemical Industries, Ltd.) | 20 parts |
| Polyvinyl alcohol (PVA 110 supplied by Kuraray Co., Ltd.) | 30 parts |
| Dye fixing agent (Catiofast PL ® supplied by BASF Japan Ltd.) | 5 parts |
| Red dye (Red G supplied by Nippon Kayaku Co., Ltd.) | 0.002 part |
| Fluorescent dye (Kaycoll BUL ® supplied by Nippon Soda Co., Ltd.) | 1 part |
| Surface active agent (Trax K-40 ® supplied by Nippon Oil & Fats Co., Ltd.) | 0.01 part |

EXAMPLE 36

An ink jet recording sheet was prepared in the same manner as in Example 28 except that the coating composition of the following formulation was used for the ink-receiving layer.

<Formulation 7 for ink-receiving layer>

| | |
|---|---|
| Silica (Carplex FPS-2 ® supplied by Shionogi & Co., Ltd.) | 100 parts |
| Colloidal silica (Snowtex C ® supplied by Nissan Chemical Industries, Ltd.) | 20 parts |
| Polyvinyl alcohol (PVA 110 supplied by Kuraray Co., Ltd.) | 30 parts |
| Dye fixing agent (Catiofast PL ® supplied by BASF Japan Ltd.) | 5 parts |
| Blue dye (Blue 16L supplied by BASF Japan Ltd.) | 0.01 part |
| Red dye (Red G supplied by Nippon Kayaku Co., Ltd.) | 0.002 part |
| Fluorescent dye (Kaycoll BUL ® supplied by Nippon Soda Co., Ltd.) | 1 part |

-continued

| | |
|---|---|
| Surface active agent (Trax K-40 ® supplied by Nippon Oil & Fats Co., Ltd.) | 0.01 part |

Psychometric lightness L and psychometric chroma coordinates a and b of the thus obtained ink jet recording sheets were measured by a color and color-difference meter CR-100 supplied by Minolta Camera Co., Ltd. and the results are shown in Table 3 together with the results of visual evaluation.

TABLE 3

| | L | a | b | Visual evaluation |
|---|---|---|---|---|
| Example 28 | 87.58 | −0.62 | −1.87 | Superior whiteness |
| Example 29 | 88.73 | 1.08 | 2.17 | Superior whiteness |
| Example 30 | 93.29 | −1.25 | −2.28 | Superior whiteness |
| Example 31 | 91.46 | 0.75 | −1.51 | Superior whiteness |
| Example 32 | 83.29 | −0.24 | 3.86 | Grayish and yellowish |
| Example 33 | 89.23 | −2.98 | −2.65 | Greenish |
| Example 34 | 88.16 | 2.32 | 0.39 | Reddish |
| Example 35 | 89.54 | 1.27 | 3.15 | Yellowish |
| Example 36 | 87.50 | −1.84 | −3.83 | Bluish |

As can be seen from the results of Table 3, the ink jet recording sheets of Examples 28–31 had visually excellent whiteness and were superior in color reproducibility of image. On the other hand, the ink jet recording sheet of Example 32 decreased in the value L and became grayish and yellowish since it did not contain blue dye, red dye and fluorescent dye. The ink jet recording sheet of Example 33 decreased in the value a and became greenish since it did not contain red dye. The ink jet recording sheet of Example 34 increased in the value a and became reddish since it contained the red dye in a large amount. The ink jet recording sheet of Example 35 increased in the value b and became yellowish since it did not contain blue dye. The ink jet recording sheet of Example 36 decreased in the value b and became bluish since it contained the blue dye in a large amount.

As described above, an ink jet recording sheet having visually excellent whiteness, capable of providing sharp image and superior in color reproducibility can be obtained when the psychometric lightness L and the psychometric chroma coordinates a and b of the surface of the ink-receiving layer are within the specific ranges.

EXAMPLE 37

A base paper having a basis weight of 100 g/m$^2$ and formed of the following stock furnish produced by Fourdrinier machine.

<Furnish 1 of base paper>

| | |
|---|---|
| LBKP | 100 parts |
| Cationized starch (CATO 302 ® supplied by Oji National Co., Ltd.) | 10 parts |
| Polyacrylamide (Hymoloc KL-86 ® supplied by Hymo Co., Ltd.) | 0.2 part |
| Alkyl ketene dimer (Hercon 601 ® supplied by Dick Hercules Co., Ltd.) | 0.5 part |
| Polyamide-epichlorohydrin resin (Kymene 2064 ® supplied by Dick Hercules Co., Ltd.) | 0.5 part |
| Blue dye (Blue B supplied by Nippon Kayaku Co., Ltd.) | 0.5 part |

-continued

| | |
|---|---|
| Red dye (Red B supplied by Nippon Kayaku Co., Ltd.) | 0.5 part |

The resulting base paper was impregnated with an impregnating solution of the following formulation at a dry weight of 2.0 g/m$^2$ using a size press.

<Formulation 1 of impregnating solution>

| | |
|---|---|
| Polyvinyl alcohol (PVA 110 supplied by Kuraray Co., Ltd.) | 2 parts |
| Fluorescent dye (Kaycoll BUL ® supplied by Nippon Soda Co., Ltd.) | 0.2 part |
| Electroconducting agent (Chemistat 6120 ® supplied by Sanyo Kasei Kogyo Co., Ltd.) | 1 part |

The back side of the base paper was subjected to corona discharge treatment and then provided with a back side resin coat layer of the following formulation at a thickness of 20 μm by melt extrusion coating method.

<Formulation 1 of back side resin coat layer>

| | |
|---|---|
| Low-density polyethylene (density: 0.92 g/cm$^3$) | 30 parts |
| High-density polyethylene (density: 0.96 g/cm$^3$) | 70 parts |

Furthermore, the front side of the base paper was subjected to corona discharge treatment and then provided with a front side resin coat layer of the following formulation at a thickness of 20 μm by melt extrusion coating method to obtain a support.

<Formulation 1 of front side resin coat layer>

| | |
|---|---|
| Low-density polyethylene (density: 0.92 g/cm$^3$) | 74 parts |
| High-density polyethylene (density: 0.97 g/cm$^3$) | 15 parts |
| White pigment (anatase type titanium dioxide) | 10 parts |
| Blue pigment (ultramarine) | 0.5 part |
| Zinc stearate | 0.5 part |

The front side of the above support was subjected to corona discharge treatment and then coated with a coating composition for an intermediate layer of the following formulation at a dry coating weight of 0.1 g/m$^2$ by an air knife coater and dried.

<Formulation 1 of coating composition for intermediate layer>

| | |
|---|---|
| Gelatin | 100 parts |
| Hardener (Denacol EX-810 ® supplied by Nagase Kasei Kogyo Co., Ltd.) | 1 part |
| Surface active agent (Rapisol B-30 ® supplied by Nippon Oil & Fats Co., Ltd.) | 0.05 part |

The back side of the above support was subjected to corona discharge treatment and then coated with a coating composition for back coat layer of the following formulation at a dry coating weight of 5 g/m$^2$ by a wire bar coater and dried.

<Formulation 1 of coating composition for back coat layer>

| | |
|---|---|
| Gelatin | 100 parts |
| Silica (Carplex-FPS-2 ® supplied by Shionogi & Co., Ltd.) | 10 parts |
| Hardener (Denacol EX-810 ® supplied by Nagase Kasei Kogyo Co., Ltd.) | 1 part |
| Electroconducting agent (Chemistat 6120 ® supplied by Sanyo Kasei Kogyo Co., Ltd.) | 1 part |
| Surface active agent (Rapisol B-30 ® supplied by Nippon Oil & Fats Co., Ltd.) | 0.05 part |

Furthermore, on the intermediate layer was coated with a coating composition for ink-receiving layer of the following formulation at a dry coating weight of 10 g/m$^2$ by an air knife coater and dried to obtain an ink jet recording sheet.

<Formulation 8 of coating composition for ink-receiving layer>

| | |
|---|---|
| Silica (Carplex FPS-2 ® supplied by Shionogi & Co., Ltd.) | 100 parts |
| Colloidal silica (Snowtex C ® supplied by Nissan Chemical Industries, Ltd.) | 20 parts |
| Polyvinyl alcohol (PVA 110 supplied by Kuraray Co., Ltd.) | 30 parts |
| Dye fixing agent (Catiofast PL ® supplied by BASF Japan Co., Ltd.) | 5 parts |
| Surface active agent (Trax. K-40 ® supplied by Nippon Oil & Fats Co., Ltd.) | 0.01 part |

EXAMPLE 38

On the front side of the base paper of Example 37 was provided with a front side resin coat layer of the following formulation at a dry weight of 20 g/m$^2$ using an air knife coater.

<Formulation 2 of front side resin coat layer>

| | |
|---|---|
| Polyethylene emulsion (Zaikthene-A ® supplied by Seitestu Kagaku Co., Ltd.) | 100 parts |
| White pigment (barium sulfate) | 50 parts |
| Blue dye (Blue B supplied by Nippon Kayaku Co., Ltd.) | 0.1 part |
| Red dye (Red B supplied by Nippon Kayaku Co., Ltd.) | 0.1 part |

On the back side of the base paper was provided with a back side resin coat layer of the following formulation at a dry weight of 20 g/m$^2$ using an air knife coater to obtain a support.

<Formulation 2 of back side resin coat layer>

| | |
|---|---|
| Polyethylene emulsion (Zaikthene-A ® supplied by Seitestu Kagaku Co., Ltd.) | 100 parts |

On the front side of the resulting support was coated with a coating composition for ink-receiving layer of the following formulation at a dry coating weight of 8 g/m$^2$ by a wire bar coater and dried to obtain an ink jet recording sheet.

<Formulation 9 of coating composition for ink-receiving layer>

| | |
|---|---|
| Gelatin | 10 parts |
| Polyvinyl alcohol (PVA 110 supplied by Kuraray Co., Ltd.) | 30 parts |

-continued

| | |
|---|---|
| Surface active agent (Trax K-40 ® supplied by Nippon Oil & Fats Co., Ltd.) | 0.01 part |

EXAMPLE 39

An ink jet recording sheet was produced in the same manner as in Example 37 except that an impregnating solution of the following formulation was used.

<Formulation 2 of impregnating solution>

| | |
|---|---|
| Polyvinyl alcohol (PVA 110 supplied by Kuraray Co., Ltd.) | 2 parts |
| Fluorescent dye (Kaycoll BUL ® supplied by Nippon Soda Co., Ltd.) | 0.05 part |
| Electroconducting agent (Chemistat 6120 ® supplied by Sanyo Kasei Kogyo Co., Ltd.) | 1 part |

EXAMPLE 40

An ink jet recording sheet was produced in the same manner as in Example 37 except that the following stock furnish was used for making the base paper.

<Furnish 2 of base paper>

| | |
|---|---|
| LBKP | 100 parts |
| Cationized starch (CATO 302 ® supplied by Oji National Co., Ltd.) | 10 parts |
| Polyacrylamide (Hymoloc KL-86 ® supplied by Hymo Co., Ltd.) | 0.2 part |
| Alkyl ketene dimer (Hercon 601 ® supplied by Dick Hercules Co., Ltd.) | 0.5 part |
| Polyamide-epichlorohydrin resin (Kymene 2064 ® supplied by Dick Hercules Co., Ltd.) | 0.5 part |
| Blue dye (Blue B supplied by Nippon Kayaku Co., Ltd.) | 0.5 part |
| Red dye (Red B supplied by Nippon Kayaku Co., Ltd.) | 0.2 part |

EXAMPLE 41

An ink jet recording sheet was produced in the same manner as in Example 37 except that the following stock furnish was used for making the base paper.

<Furnish 3 of base paper>

| | |
|---|---|
| LBKP | 100 parts |
| Cationized starch (CATO 302 ® supplied by Oji National Co., Ltd.) | 10 parts |
| Polyacrylamide (Hymoloc KL-86 ® supplied by Hymo Co., Ltd.) | 0.2 part |
| Alkyl ketene dimer (Hercon 601 ® supplied by Dick Hercules Co., Ltd.) | 0.5 part |
| Polyamide-epichlorohydrin resin (Kymene 2064 ® supplied by Dick Hercules Co., Ltd.) | 0.5 part |
| Blue dye (Blue B supplied by Nippon Kayaku Co., Ltd.) | 0.2 part |
| Red dye (Red B supplied by Nippon Kayaku Co., Ltd.) | 0.5 part |

EXAMPLE 42

An ink jet recording sheet was produced in the same manner as in Example 37 except that the following composition was used for the front side resin coat layer.

<Formulation 3 of front side resin coat layer>

| | |
|---|---|
| Low-density polyethylene (density: 0.92 g/cm$^3$) | 70 parts |
| High-density polyethylene (density: 0.97 g/cm$^3$) | 15 parts |
| White pigment (anatase type titanium dioxide) | 5 parts |
| Blue pigment (ultramarine) | 0.5 part |
| Zinc stearate | 0.5 part |

EXAMPLE 43

An ink jet recording sheet was produced in the same manner as in Example 37 except that the following stock furnish was used for making the base paper.

<Furnish 4 of base paper>

| | |
|---|---|
| LBKP | 100 parts |
| Cationized starch (CATO 302 ® supplied by Oji National Co., Ltd.) | 10 parts |
| Polyacrylamide (Hymoloc KL-86 ® supplied by Hymo Co., Ltd.) | 0.2 part |
| Alkyl ketene dimer (Hercon 601 ® supplied by Dick Hercules Co., Ltd.) | 0.5 part |
| Polyamide-epichlorohydrin resin (Kymene 2064 ® supplied by Dick Hercules Co., Ltd.) | 0.5 part |
| Blue dye (Blue B supplied by Nippon Kayaku Co., Ltd.) | 0.5 part |

EXAMPLE 44

An ink jet recording sheet was produced in the same manner as in Example 37 except that the following composition was used for making the base paper.

<Furnish 5 of base paper>

| | |
|---|---|
| LBKP | 100 parts |
| Cationized starch (CATO 302 ® supplied by Oji National Co., Ltd.) | 10 parts |
| Polyacrylamide (Hymoloc KL-86 ® supplied by Hymo Co., Ltd.) | 0.2 part |
| Alkyl ketene dimer (Hercon 601 ® supplied by Dick Hercules Co., Ltd.) | 0.5 part |
| Polyamide-epichlorohydrin resin (Kymene 2064 ® supplied by Dick Hercules Co., Ltd.) | 0.5 part |
| Blue dye (Blue B supplied by Nippon Kayaku Co., Ltd.) | 0.5 part |
| Red dye (Red B supplied by Nippon Kayaku Co., Ltd.) | 1.0 part |

EXAMPLE 45

An ink jet recording sheet was produced in the same manner as in Example 37 except that the following composition was used for the front side resin coat layer.

<Formulation 4 of front side resin coat layer>

| | |
|---|---|
| Low-density polyethylene (density: 0.92 g/cm$^3$) | 70 parts |
| High-density polyethylene (density: 0.97 g/cm$^3$) | 15 parts |
| White pigment (anatase type titanium dioxide) | 10 parts |
| Zinc stearate | 0.5 part |

EXAMPLE 46

An ink jet recording sheet was produced in the same manner as in Example 37 except that the following composition was used for the front side resin coat layer.

<Formulation 5 of front side resin coat layer>

| | |
|---|---|
| Low-density polyethylene (density: 0.92 g/cm$^3$) | 70 parts |
| High-density polyethylene (density: 0.97 g/cm$^3$) | 15 parts |
| White pigment (anatase type titanium dioxide) | 10 parts |
| Blue pigment (ultramarine) | 1 part |
| Zinc stearate | 0.5 part |

The values L, a and b of the surface of the support on which the ink-receiving layer is provided were measured by a color and color-difference meter CR-100 supplied by Minolta Camera Co., Ltd. and the results are shown in Table 4 together with the results of visual evaluation of the ink jet image receiving sheet coated with the ink-receiving layer.

TABLE 4

| | L | a | b | Visual evaluation |
|---|---|---|---|---|
| Example 37 | 91.24 | −0.82 | −2.27 | Superior whiteness |
| Example 38 | 92.36 | 1.13 | −0.95 | " |
| Example 39 | 90.29 | 0.75 | −1.28 | " |
| Example 40 | 91.80 | −1.76 | −3.11 | " |
| Example 41 | 92.08 | 0.41 | −0.64 | " |
| Example 42 | 88.74 | 0.29 | 0.86 | Grayish and yellowish |
| Example 43 | 92.63 | −2.31 | −4.35 | Greenish |
| Example 44 | 90.82 | 2.45 | −0.49 | Reddish |
| Example 45 | 91.46 | 1.39 | 1.28 | Yellowish |
| Example 46 | 90.30 | −1.84 | −5.83 | Bluish |

As can be seen from the results of Table 4, the ink jet recording sheet of Examples 37–41 according to the present invention had visually excellent whiteness and were superior in color reproducibility. On the other hand, the ink jet recording sheet of Example 42 was low in the values L and b and grayish and yellowish since content of the white pigment in the resin coat layer on the front side of the support was small. The ink jet recording sheet of Example 43 was low in the value a and greenish since the base paper did not contain red dye. The ink jet recording sheet of Example 44 was high in the value a and reddish since the base paper contained the red dye in a large amount. The ink jet recording sheet of Example 45 was high in the value b and yellowish since the front side resin coat layer did not contain blue dye. The ink jet recording sheet of Example 46 was low in the value b and bluish since the front side resin coat layer contained the blue dye in a large amount.

As described above, an ink jet recording sheet having visually excellent whiteness, capable of providing sharp image and superior in color reproducibility can be obtained.

EXAMPLE 47

On the front side of a woodfree paper comprising 70% of LBKP and 30% of NBKP and having a basis weight of 100 g/m$^2$ was coated with a coating composition for ink-receiving layer of the following formulation at a dry coating weight of 10 g/m$^2$ by an air knife coater and dried to obtain an ink jet recording sheet.

The non-spherical cationic colloidal silica in the coating composition layer was cationized with hydrous aluminum oxide and covering amount of the hydrous aluminum oxide was 11.7% by weight based on silica (as $SiO_2$).

<Formulation 10 of coating composition for ink-receiving layer>

| | |
|---|---|
| Non-spherical cationic colloidal silica (Snowtex UP-AK(1) ® supplied by Nissan Chemical Industries, Ltd.) | 100 parts |
| Polyvinyl alcohol (PVA 117 supplied by Kuraray Co., Ltd.) | 30 parts |
| Blue dye (Blue 16L supplied by BASF Japan Co., Ltd.) | 0.002 part |
| Red dye (Red G supplied by Nippon Kayaku Co., Ltd.) | 0.002 part |
| Fluorescent dye (Kaycoll BUL ® supplied by Nippon Soda Co., Ltd.) | 1 part |
| Surface active agent (Trax K-401 ® supplied by Nippon Oil & Fats Co., Ltd.) | 0.01 part |

EXAMPLE 48

An ink jet recording sheet was prepared by coating the same coating composition for ink-receiving layer as used in Example 47 on the front side of a coated paper having a basis weight of 84.9 g/m$^2$ at a dry coating weight of 10 g/m$^2$ by an air knife coater and drying the coated paper.

EXAMPLE 49

An ink jet recording sheet was prepared by coating the same coating composition for ink-receiving layer as used in Example 47 on the front side of a white polyethylene terephthalate film having a thickness of 100 μm at a dry coating weight of 20 g/m$^2$ by a wire bar coater and drying the coated film.

EXAMPLE 50

An ink jet recording sheet was prepared by coating the same coating composition for ink-receiving layer as used in Example 47 on the front side of a polyethylene laminate paper having a basis weight of 142.5 g/m$^2$ at a dry coating weight of 20 g/m$^2$ by a wire bar coater and drying the coated paper.

EXAMPLE 51

An ink jet recording sheet was prepared in the same manner as in Example 47 except that a coating composition for ink-receiving layer of the following formulation was used.

<Formulation 11 of coating composition for ink-receiving layer>

| | |
|---|---|
| Non-spherical cationic colloidal silica (Snowtex UP-AK(1) ® supplied by Nissan Chemical Industries, Ltd.) | 100 parts |
| Polyvinyl alcohol (PVA 117 supplied by Kuraray Co., Ltd.) | 30 parts |
| Surface active agent (Trax K-40 ® supplied by Nippon Oil & Fats Co., Ltd.) | 0.01 part |

EXAMPLE 52

An ink jet recording sheet was prepared in the same manner as in Example 47 except that a coating composition for ink-receiving layer of the following formulation was used.

<Formulation 11 of coating composition for ink-receiving layer>

| | |
|---|---|
| Non-spherical cationic colloidal silica (Snowtex UP-AK(1) ® supplied by Nissan Chemical Industries, Ltd.) | 100 parts |
| Polyvinyl alcohol (PVA 117 supplied by Kuraray Co., Ltd.) | 30 parts |
| Blue dye (Blue 16L supplied by BASF Japan Co., Ltd.) | 0.002 part |
| Fluorescent dye (Kaycoll BUL ® supplied by Nippon Soda Co., Ltd.) | 1 part |
| Surface active agent (Trax K-40 ® supplied by Nippon Oil & Fats Co., Ltd.) | 0.01 part |

EXAMPLE 53

An ink jet recording sheet was prepared in the same manner as in Example 47 except that a coating composition for ink-receiving layer of the following formulation was used.

<Formulation 12 of coating composition for ink-receiving layer>

| | |
|---|---|
| Non-spherical cationic colloidal silica (Snowtex UP-AK(1) ® supplied by Nissan Chemical Industries, Ltd.) | 100 parts |
| Polyvinyl alcohol (PVA 117 supplied by Kuraray Co., Ltd.) | 30 parts |
| Blue dye (Blue 16L supplied by BASF Japan Co., Ltd.) | 0.002 part |
| Red dye (Red G supplied by Nippon Kayaku Co., Ltd.) | 0.01 part |
| Fluorescent dye (Kaycoll BUL ® supplied by Nippon Soda Co., Ltd.) | 1 part |
| Surface active agent (Trax K-40 ® supplied by Nippon Oil & Fats Co., Ltd.) | 0.01 part |

EXAMPLE 54

An ink jet recording sheet was prepared in the same manner as in Example 47 except that a coating composition for ink-receiving layer of the following formulation was used. <Formulation 13 of coating composition for ink-receiving layer>

| | |
|---|---|
| Non-spherical cationic colloidal silica (Snowtex UP-AK(1) ® supplied by Nissan Chemical Industries, Ltd.) | 100 parts |
| Polyvinyl alcohol (PVA 117 supplied by Kuraray Co., Ltd.) | 30 parts |
| Red dye (Red G supplied by Nippon Kayaku Co., Ltd.) | 0.002 part |
| Fluorescent dye (Kaycoll BUL ® supplied by Nippon Soda Co., Ltd.) | 1 part |
| Surface active agent (Trax K-40 ® supplied by Nippon Oil & Fats Co., Ltd.) | 0.01 part |

EXAMPLE 55

An ink jet recording sheet was prepared in the same manner as in Example 47 except that a coating composition for ink-receiving layer of the following formulation was used.

<Formulation 14 of coating composition for ink-receiving layer>

| | |
|---|---|
| Non-spherical cationic colloidal silica (Snowtex UP-AK(1) ® supplied by Nissan Chemical Industries, Ltd.) | 100 parts |
| Polyvinyl alcohol (PVA 117 supplied by Kuraray Co., Ltd.) | 30 parts |
| Blue dye (Blue 16L supplied by BASF Japan Co., Ltd.) | 0.01 part |
| Red dye (Red G supplied by Nippon Kayaku Co., Ltd.) | 0.002 part |
| Fluorescent dye (Kaycoll BUL ® supplied by Nippon Soda Co., Ltd.) | 1 part |
| Surface active agent (Trax K-40 ® supplied by Nippon Oil & Fats Co., Ltd.) | 0.01 part |

EXAMPLE 56

An ink jet recording sheet was prepared in the same manner as in Example 47 except that a coating composition for ink-receiving layer of the following formulation was used.

<Formulation 15 of coating composition for ink-receiving layer>

| | |
|---|---|
| Non-spherical cationic colloidal silica (Snowtex UP-AK(1) ® supplied by Nissan Chemical Industries, Ltd.) | 100 parts |
| Polyvinyl alcohol (PVA 117 supplied by Kuraray Co., Ltd.) | 30 parts |
| Blue dye (Blue 16L supplied by BASF Japan Co., Ltd.) | 0.002 part |
| Red dye (Red G supplied by Nippon Kayaku Co., Ltd.) | 0.002 part |
| Fluorescent dye (Kaycoll BUL ® supplied by Nippon Soda Co., Ltd.) | 1 part |
| Surface active agent (Trax K-40 ® supplied by Nippon Oil & Fats Co., Ltd.) | 0.01 part |

EXAMPLE 57

An ink jet recording sheet was prepared in the same manner as in Example 47 except that a coating composition for ink-receiving layer having the following formulation was used.

<Formulation 16 of coating composition for ink-receiving layer>

| | |
|---|---|
| Spherical cationic colloidal silica (Snowtex-AK ® supplied by Nissan Chemical Industries, Ltd.) | 100 parts |
| Polyvinyl alcohol (PVA 117 supplied by Kuraray Co., Ltd.) | 30 parts |
| Blue dye (Blue 16L supplied by BASF Japan Co., Ltd.) | 0.002 part |
| Red dye (Red G supplied by Nippon Kayaku Co., Ltd.) | 0.002 part |
| Fluorescent dye (Kaycoll BUL ® supplied by Nippon Soda Co., Ltd.) | 1 part |
| Surface active agent (Trax K-40 ® supplied by Nippon Oil & Fats Co., Ltd.) | 0.01 part |

The psychometric lightness L and psychometric chroma coordinates a and b of the ink jet recording sheets obtained above were measured by a color and color-difference meter CR-100 supplied by Minolta Camera Co., Ltd. Furthermore, visual evaluation was also conducted. Moreover, images were recorded on the specimen sheets by ink jet printer Desk Writer C supplied by Hewlett Packard Co., Ltd. and subjected to the following quality tests. The results are shown in Table 5.

[Dot reproducibility]

The recorded image was evaluated by a microscope and diameter and shape of the image were visually evaluated.

The criteria of the evaluation are as follows:

○: Good x : Bad

[Water resistance]

After lapse of 30 minutes from ink jet recording of the image on the specimen sheet, the specimen sheet was dipped in stored water for 5 minutes. Then, the sheet was taken out from water and dried. The state of the image retained and the state of the image spread were visually evaluated.

The criteria of the evaluation are as follows:

○: Good x: Bad

TABLE 5

| | L | a | b | Visual evaluation | Dot reproducibility | Water resistance |
|---|---|---|---|---|---|---|
| Example 47 | 87.58 | −0.62 | −1.87 | Superior whiteness | ○ | ○ |
| Example 48 | 88.73 | 1.08 | 2.17 | Superior whiteness | ○ | ○ |
| Example 49 | 93.29 | −1.25 | −2.28 | Superior whiteness | ○ | ○ |
| Example 50 | 91.46 | 0.75 | −1.51 | Superior whiteness | ○ | ○ |
| Example 51 | 83.29 | −0.24 | 3.86 | Grayish and yellowish | ○ | ○ |
| Example 52 | 89.23 | −2.98 | −2.65 | Greenish | ○ | ○ |
| Example 53 | 88.16 | 2.32 | 0.39 | Reddish | ○ | ○ |
| Example 54 | 89.54 | 1.27 | 3.15 | Yellowish | ○ | ○ |
| Example 55 | 87.50 | −1.84 | −3.83 | Bluish | ○ | ○ |
| Example 56 | 87.47 | −0.58 | −1.78 | Superior whiteness | x | x |
| Example 57 | 87.65 | −0.60 | −1.80 | Superior whiteness | x | ○ |

As can be seen from the results of Table 5, the ink jet recording sheets of Examples 47–50 had visually excellent whiteness and were superior in color reproducibility of the image, dot reproducibility and water resistance. On the other hand, the ink jet recording sheet of Example 51 was low in the value L and grayish and yellowish since blue dye, red dye and fluorescent dye were not contained. The ink jet recording sheet of Example 52 was low in the value a and greenish since red dye was not contained. The ink jet recording sheet of Example 53 was high in the value a and reddish since the red dye was contained in a large amount. The ink jet recording sheet of Example 54 was high in the value b and yellowish since blue dye was not contained. The ink jet recording sheet of Example 55 was low in the value b and bluish since the blue dye was contained in a large amount. The ink jet recording sheet of Example 56 was inferior in dot reproducibility and water resistance since non-spherical colloidal silica which was not cationized was used. The ink jet recording sheet of Example 57 was inferior in dot reproducibility although it was superior in water resistance since cationized spherical colloidal silica was used.

As described above, an ink jet recording sheet having visually excellent whiteness, capable of providing sharp images and superior in color reproducibility and water resistance can be obtained.

INDUSTRIAL APPLICABILITY

The ink jet recording sheets of the present invention give excellent images so that the recording sheets can be used in various fields of producing full-color copies of photographic quality such as printing, fashion, promotion and the like industries.

We claim:

1. An ink jet recording sheet consisting essentially of a support and an ink-receiving layer provided on the support wherein the ink-receiving layer contains a low-molecular weight gelatin having a molecular weight of 100,000 or less in an amount of 30% by weight or more in solid content based on the total solid content of the ink-receiving layer, mucochloric acid in an amount of 0.1–1.0% by weight in solid content based on the content of gelatin and carboxymethylcellulose having a molecular weight of 100,000 or less and an etherification degree of 1% or less.

2. An ink jet recording sheet according to claim 1, wherein the support is a polyolefin resin-coated paper.

3. An ink jet recording sheet according to claim 1, wherein the support is a polyester film.

4. An ink jet recording sheet according to claim 2, wherein the polyolefin resin is a polyethylene resin.

* * * * *